US005291706A

United States Patent [19]

Beardsley et al.

[11] Patent Number: 5,291,706

[45] Date of Patent: Mar. 8, 1994

[54] MODULAR CHIMNEY ARRANGEMENT

[76] Inventors: Jack M. Beardsley, 1961 Bellevue Dr., Glendale, Calif. 91201; Kendall L. Beardsley, 10799 Sherman Grove Ave., #34, Sunland, Calif. 91040; Craig M. Beardsley, P.O. Box 3433, Glendale, Calif. 91221-0433

[21] Appl. No.: 973,661

[22] Filed: Nov. 9, 1992

[51] Int. Cl.[5] ..... E04H 12/18

[52] U.S. Cl. ..... 52/218; 52/219; 52/344; 52/388; 248/149; 248/523

[58] Field of Search ..... 52/27, 218, 219, 264, 52/79.6, 344, 388; 248/503, 527, 529, 237, 149, 159, 220.2

[56] References Cited

U.S. PATENT DOCUMENTS

| | | | |
|---|---|---|---|
| 865,372 | 9/1907 | Flynn | 52/218 |
| 3,089,521 | 5/1963 | Paiement | 52/219 |
| 3,426,490 | 2/1969 | Taylor | 52/388 |
| 4,672,782 | 6/1987 | Richter et al. . | |
| 4,917,345 | 4/1900 | Czech | 248/237 |
| 4,962,621 | 10/1990 | Pura . | |
| 5,016,853 | 5/1991 | Cox | 248/529 |
| 5,181,460 | 1/1993 | Grenelsbacker | 248/149 |

FOREIGN PATENT DOCUMENTS

| | | | |
|---|---|---|---|
| 1143626 | 2/1963 | Fed. Rep. of Germany | 52/219 |
| 3103413 | 2/1983 | Fed. Rep. of Germany | 52/218 |
| 1587199 | 4/1981 | United Kingdom | 52/219 |

*Primary Examiner*—Carl D. Friedman
*Assistant Examiner*—Winnie Yip
*Attorney, Agent, or Firm*—Leon Gilden

[57] ABSTRACT

Modular chimney components are arranged for interengaging relative to one another, wherein each component includes a base member having a support plate receiving four inner flanges at four corners of the support plate, with second outer flanges projecting upwardly of the inner flanges to mount a continuous mesh fence thereabout, wherein the mesh fence is arranged to receive a mortar layer thereon to an interior surface thereof, with the mortar layer projecting through the mesh fence securing a matrix of work plates continuously to an exterior surface of the fence. The modular components are arranged for interengagement relative to one another to provide for a chimney covering arrangement about a flue.

3 Claims, 4 Drawing Sheets

MODULAR CHIMNEY ARRANGEMENT

BACKGROUND OF THE INVENTION

1. Field of the Invention

The field of invention relates to chimney structure, and more particularly pertains to a new and improved modular chimney arrangement wherein the same is arranged for mounting about a chimney flue.

2. Description of the Prior Art

Construction components used to surround a chimney flue are available in the prior art, wherein the U.S. Pat. No. 4,962,621 to Pura sets forth modular chimney components utilizing plural courses of bricks of an enclosed shape to receive a chimney therethrough.

Further examples of chimney cover structure is indicated in U.S. Pat. No. 4,672,782.

The instant invention attempts to overcome deficiencies of the prior art by providing for modular components arranged for interengagement relative to one another in surrounding relationship relative to a chimney flue to provide for a secure, readily assembled structure arranged for ease of use as well as effectiveness in construction and in this respect, the present invention substantially fulfills this need.

SUMMARY OF THE INVENTION

In view of the foregoing disadvantages inherent in the known types of chimney structure now present in the prior art, the present invention provides a modular chimney arrangement wherein the same is arranged for surrounding a chimney flue, with the modular chimney arrangement arranged for mounting to a dwelling. As such, the general purpose of the present invention, which will be described subsequently in greater detail, is to provide a new and improved modular chimney arrangement which has all the advantages of the prior art modular chimney structure and none of the disadvantages.

To attain this, the present invention provides modular chimney components arranged for interengaging relative to one another, wherein each component includes a base member having a support plate receiving four inner flanges at four corners of the support plate, with second outer flanges projecting upwardly of the inner flanges to mount a continuous mesh fence thereabout, wherein the mesh fence is arranged to receive a mortar layer thereon to an interior surface thereof, with the mortar layer projecting through the mesh fence securing a matrix of work plates continuously to an exterior surface of the fence. The modular components are arranged for interengagement relative to one another to provide for a chimney covering arrangement about a flue.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved modular chimney arrangement which has all the advantages of the prior art modular chimney structure and none of the disadvantages.

It is another object of the present invention to provide a new and improved modular chimney arrangement which may be easily and efficiently manufactured and marketed.

It is a further object of the present invention to provide a new and improved modular chimney arrangement which is of a durable and reliable construction.

An even further object of the present invention is to provide a new and improved modular chimney arrangement which is susceptible of a low cost of manufacture with regard to both materials and labor, and which accordingly is then susceptible of low prices of sale to the consuming public, thereby making such modular chimney arrangements economically available to the buying public.

Still yet another object of the present invention is to provide a new and improved modular chimney arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
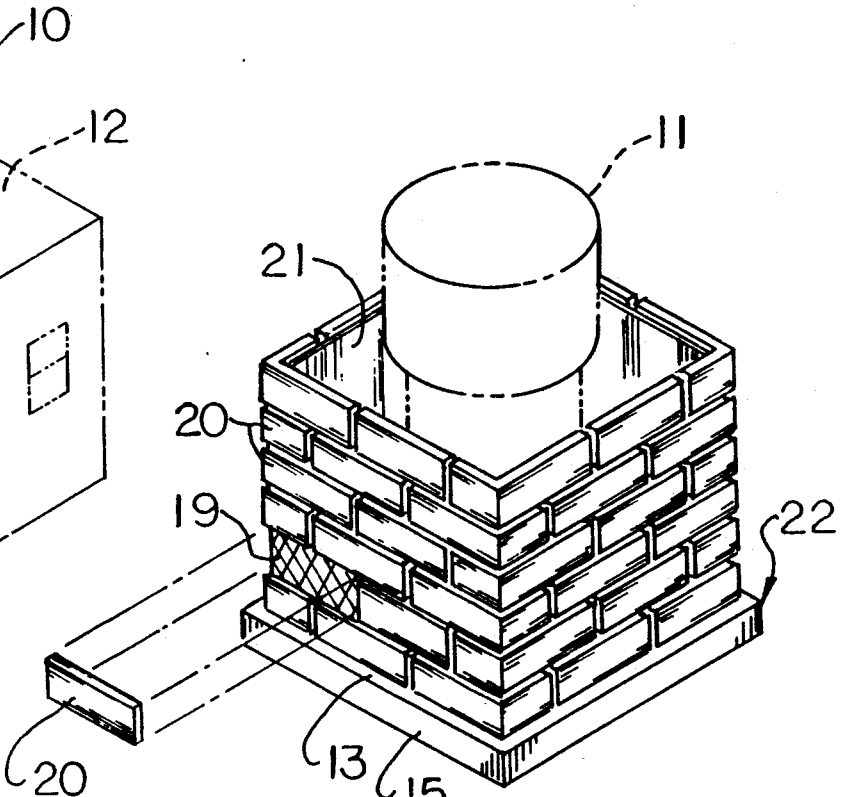
FIG. 2 is an enlarged isometric illustration of the invention in an assembled configuration.

With reference now to the drawings, and in particular to FIGS. 1 to 11 thereof, a new and improved modular chimney arrangement embodying the principles and concepts of the present invention and generally designated by the reference numeral 10 will be described.

Figure 1:
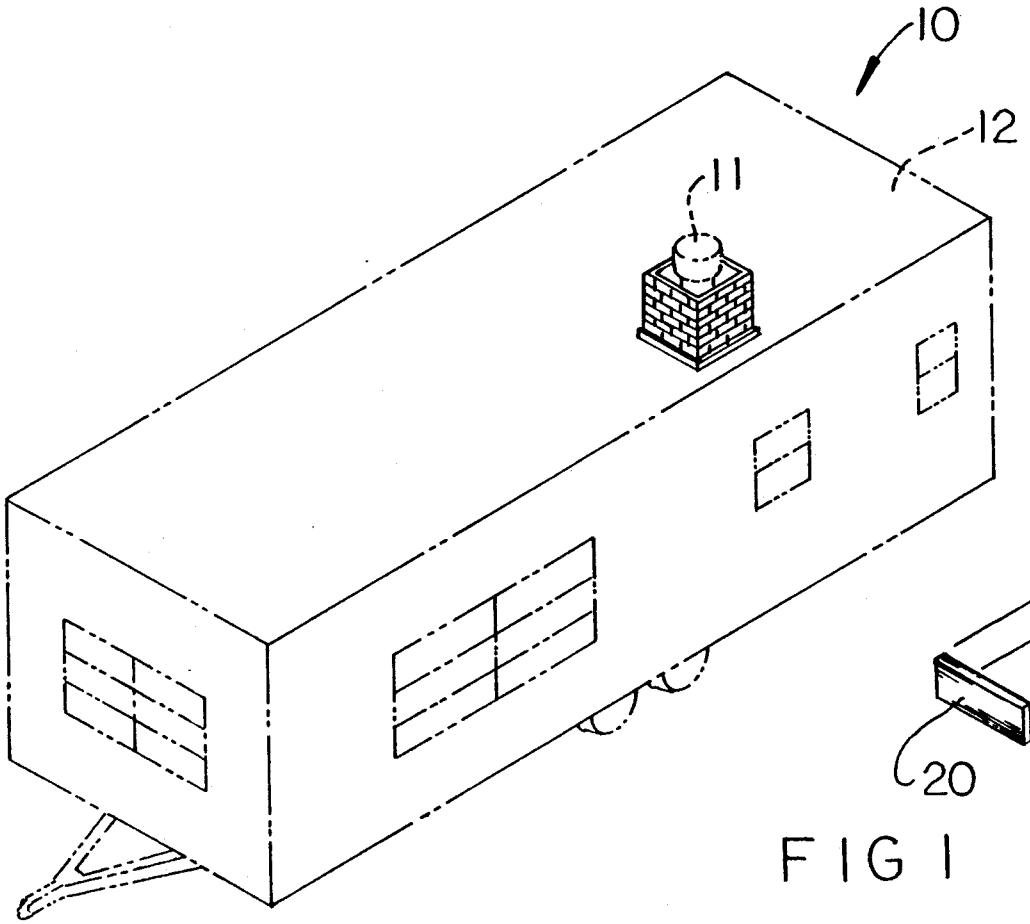
FIG. 1 is an isometric illustration of the invention in use.
Figure 3:
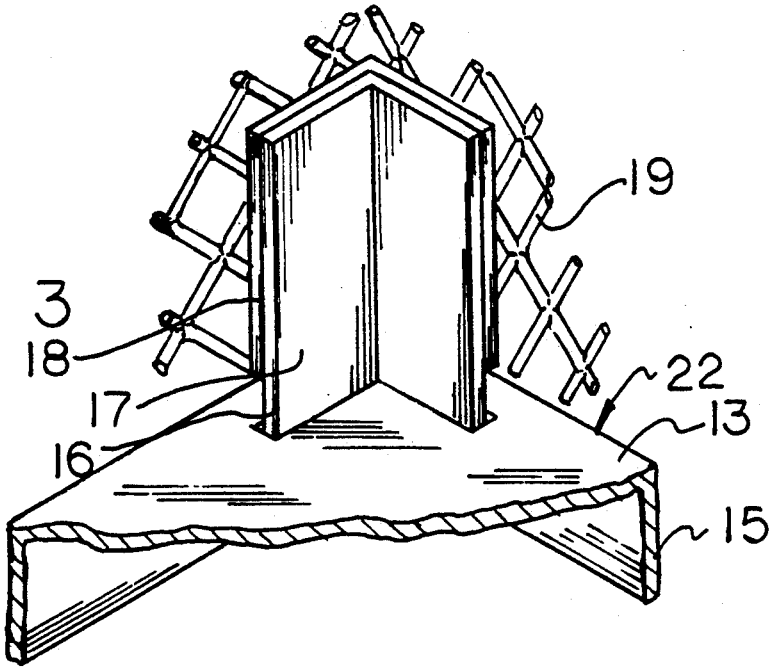
FIG. 3 is a partial isometric view of the mounting flanges secured to the support plate of the invention positioning the surrounding fence thereabout.
Figure 4:
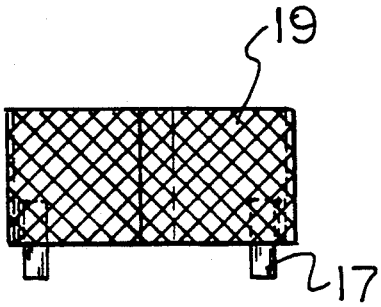
FIG. 4 is an orthographic side view of an individual modular assembly prior to securing the brick plates thereon.
Figure 7:
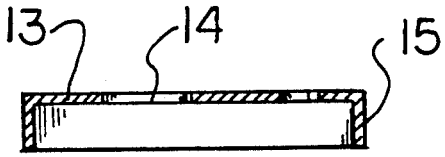
FIG. 7 is an orthographic view, taken along the lines 7—7 of FIG. 6 in the direction indicated by the arrows.
Figure 5:
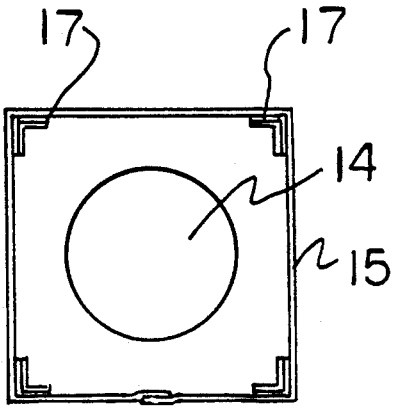
FIG. 5 is an orthographic bottom view of the support plate structure.
Figure 6:
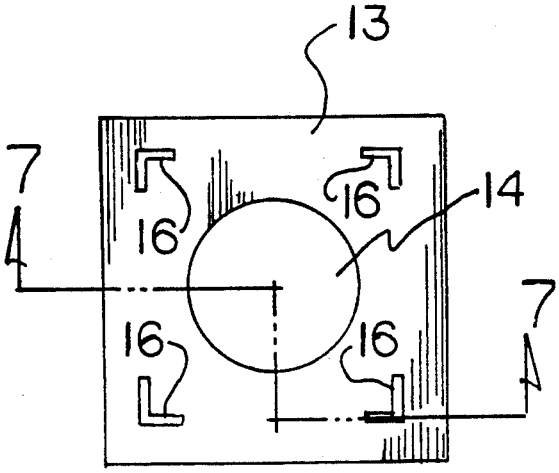
FIG. 6 is an orthographic top view of the support plate.

More specifically, the modular chimney arrangement 10 is arranged for securement about a chimney flue 11, as indicated in FIG. 1, typically directed through a building member 12. A rectilinear support plate 13 is provided of a base member 22 that includes a continuous skirt 15 projecting downwardly and orthogonally relative to an outer periphery of the support plate 13. A plurality of L-shaped slots 16, typically one at each corner of the rectilinear support plate 13, includes an L-shaped first inner flange 17 (see FIG. 3) projecting through the L-shaped slot 16, having an L-shaped second outer flange 18 fixedly mounted to the first inner flange 17, with the second outer flange 18 projecting above the support plate 13, with the first flange 17 projecting through the support flange in an orthogonal relationship relative to the support flange 13. A continuous mesh fence 19 is mounted by utilization of mechanical, adhesive, or welding techniques to the outer flange 18. Brick plates 20 defining a matrix thereof are coextensive with an exterior of the mesh fence 19 and are secured thereto by utilizing a mortar layer 21 coextensive with and projecting through the mesh fence 19 (see FIG. 2). In this manner, a plurality of such assemblies (see FIG. 11) may be interengaged relative to one another as the inner flanges 17 in lieu of mounting to a support plate 13 are received within an interior of an upper distal end of an underlying fence structure 19 to permit the selective securement of the components together.

Figure 9:
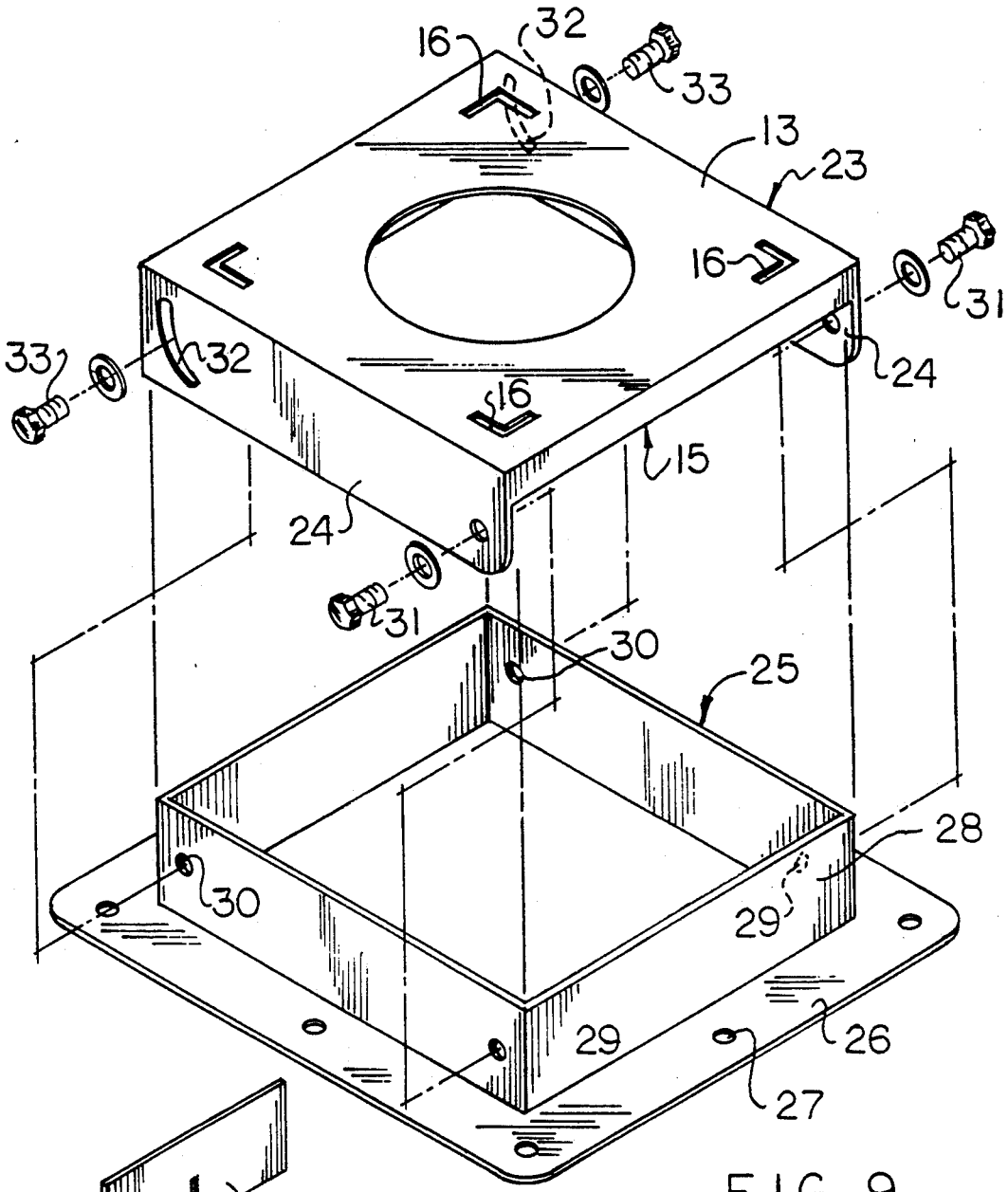
FIG. 9 is an isometric illustration of a modified base member for use by the invention.

The FIG. 9 indicates the use of a modified base member 23 that includes a mounting assembly 25 having a mounting flange 26 arranged for mounting to the roof of the building member 12, with the mounting assembly 25 having flange apertures 27 directed to the flange 26 for such purpose to receive fasteners through the mounting apertures 27.

A continuous support frame 28 projects upwardly of in an orthogonal relationship relative to an interior periphery of the mounting flange 26, with the support frame 28 arranged for complementarily being received within the continuous skirt 15 of the modified base member 23. First coaxially aligned apertures 29 are directed through opposed side walls of the support frame 28 to receive first aperture fasteners 31 therethrough to associated fasteners in opposed side walls of the skirt, or more particularly, skirt plates 24 that are parallel of the modified base member 23 for pivoting about the first aperture fasteners 31. Second coaxially aligned apertures 30 directed through the support frame 28 receive second aperture fasteners 33 therethrough and through associated base member aligned arcuate slots 32. In this manner, pivoting of the support plate 13 of the modified base member 23 is provided to accommodate various angular misalignments of the associated chimney flue 11 relative to the roof surface of the building member 12 to provide for coaxial alignment of the flue 11 medially of the modular chimney arrangement 10.

Figure 8:
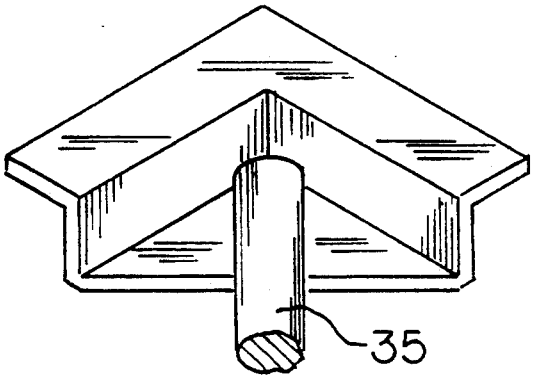
FIG. 8 is an isometric illustration of section 8, as set forth in FIG. 11.
Figure 10:
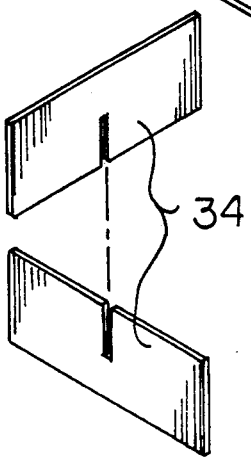
FIG. 10 is an isometric illustration of the stabilizing flanges for use by the invention.

The FIG. 10 indicates the use of stabilizing flanges 34 that are crosses and are arranged for positioning within the fence 11 during application of the brick plates 20 thereon for subsequent removal. Further, stabilizing rods 35 are provided diametrically crossing relative to one another to secure anchor members, as indicated in FIG. 8, for proper alignment of the flanges and fence structure during their assembly.

Figure 11:
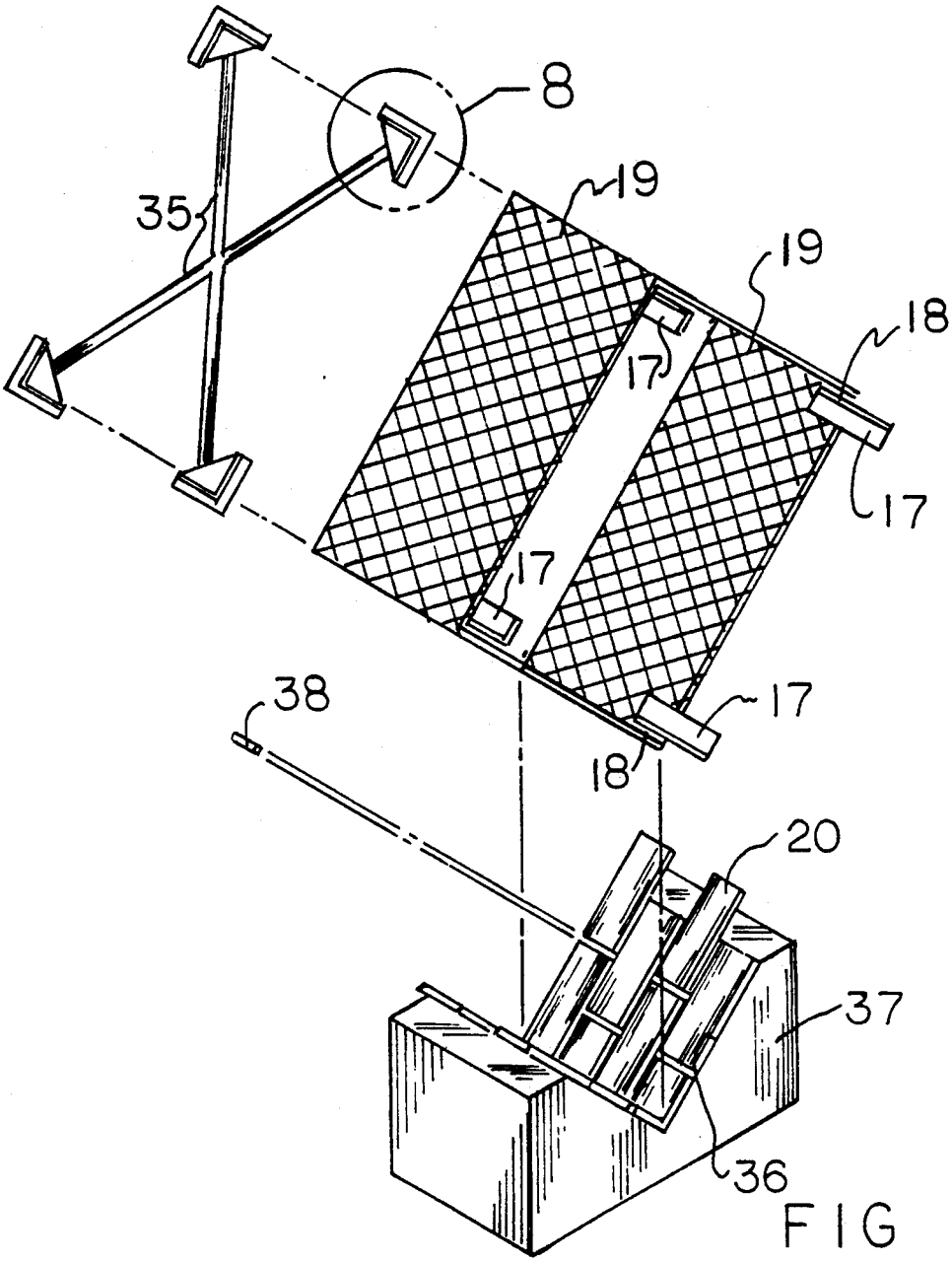
FIG. 11 is an isometric illustration indicating a manner of assembling the brick plates relative to the mesh fence.

The FIG. 11 further indicates the use of an optional support block 37 having a V-shaped block recess 36 mounting the brick plates 20 thereon, whereupon application of the motor, the corners of each fence structure are directed onto the brick plates when positioned within the V-shaped block recess 36 for their proper alignment and the speed and rapidity of their mounting to each fence portion. Further, spacer rods 38 are arranged for positioning between adjacent brick plates for their proper orientation relative to one another.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A modular chimney arrangement, comprising, a rectilinear support plate, the support plate having a central opening directed therethrough, and a continuous skirt projecting downwardly and orthogonally relative to an outer periphery of the support plate, with the support plate having a plurality of L-shaped slots directed therethrough, and the support plate having four corners, and at least one of the L-shaped slots positioned in adjacency relative to each corner, and a plurality of inner flanges, with each of said inner flanges projecting through one of the L-shaped slots, and an outer flange positioned exteriorly to each inner flange, with a continuous mesh fence mounted to each inner flange wherein the each outer flange defining a supporting surface for engaging the support plate and holding the inner flange in the L-shaped slot, and brick plates mounted to an exterior surface of the fence.

2. A chimney arrangement as set forth in claim 1 wherein a mortar layer is mounted in continuous layer through the fence adhering the brick plates to the fence.

3. A chimney arrangement as set forth in claim 2 further comprising a mounting assembly being provided having a mounting flange, the mounting flange including a support frame orthogonally mounted to an inner periphery of the flange, and the support frame complementarily received within the skirt, and the support frame having first coaxially aligned apertures directed through opposed side walls of the support frame, and second coaxially aligned apertures directed through the side walls of the support frame, wherein the first apertures include first fasteners directed through the first apertures and through the skirt, and the skirt further having aligned arcuate slots, wherein one of the arcuate slots is positioned in adjacency relative to one of the second apertures to receive second fasteners through the second apertures and the arcuate slots to permit pivoting of the support plate relative to the mounting assembly about the first fasteners.

* * * * *